US010036535B2

(12) United States Patent
Catalano

(10) Patent No.: US 10,036,535 B2
(45) Date of Patent: Jul. 31, 2018

(54) ILLUMINATION DEVICE WITH ADJUSTABLE CURVED REFLECTOR PORTIONS

(71) Applicant: TerraLUX, Inc., Longmont, CO (US)

(72) Inventor: Anthony W. Catalano, Boulder, CO (US)

(73) Assignee: Ledvance LLC, Wilmington, MA (US)

( * ) Notice: Subject to any disclaimer, the term of this patent is extended or adjusted under 35 U.S.C. 154(b) by 221 days.

(21) Appl. No.: 14/931,317

(22) Filed: Nov. 3, 2015

(65) Prior Publication Data

US 2016/0123560 A1 May 5, 2016

Related U.S. Application Data

(60) Provisional application No. 62/074,287, filed on Nov. 3, 2014.

(51) Int. Cl.
*F21V 14/04* (2006.01)
*F21V 7/06* (2006.01)
(Continued)

(52) U.S. Cl.
CPC ..... *F21V 14/04* (2013.01); *F21V 7/0058* (2013.01); *F21V 7/0066* (2013.01); *F21V 7/06* (2013.01);
(Continued)

(58) Field of Classification Search
CPC . F21V 7/0025; F21V 7/16; F21V 7/18; F21V 14/04; F21V 14/045
See application file for complete search history.

(56) References Cited

U.S. PATENT DOCUMENTS 1,621,955 A * 3/1927 Schiffner ..... F21L 4/00 362/187
2,338,078 A * 12/1943 Wood ..... F21L 15/02 362/187
(Continued)

FOREIGN PATENT DOCUMENTS

CN 102958251 A 3/2013
DE 202010016958 U1 6/2011
(Continued)

OTHER PUBLICATIONS

Menn, Patrick, "European Office Action re Application No. 13773521.3", dated Feb. 11, 2016, pp. 5, Published in: EP.
(Continued)

*Primary Examiner* — Ismael Negron
(74) *Attorney, Agent, or Firm* — Neugeboren O'Dowd PC

(57) ABSTRACT

A device has a light source, a first reflector segment having a first parabolic cross section to produce a first light distribution having a wide-angle light distribution, and a second reflector segment having a second parabolic cross section to produce a second light distribution that is narrower than the first light distribution. At least one of the first and second segments is movable between first and second positions such that a portion of the light emitted by the light source is reflected to form the first light distribution when the at least one of the first and second segments is in the first position, and a portion of the light is reflected to form the second light distribution when the at least one of the first and second segments is in the second position.

18 Claims, 6 Drawing Sheets

(51) Int. Cl.
*F21V 7/00* (2006.01)
*F21Y 105/10* (2016.01)
*F21Y 115/10* (2016.01)

(52) U.S. Cl.
CPC ..... *F21Y 2105/10* (2016.08); *F21Y 2115/10* (2016.08)

(56) References Cited

U.S. PATENT DOCUMENTS

| | | | | |
|---|---|---|---|---|
| 4,602,321 | A | 7/1986 | Bornhorst | |
| 5,060,120 | A * | 10/1991 | Kobayashi | F21S 48/1388 362/282 |
| 5,178,452 | A * | 1/1993 | Scholz | F21V 7/0025 362/304 |
| 5,582,479 | A * | 12/1996 | Thomas | F21S 8/04 362/263 |
| 5,789,866 | A | 8/1998 | Keith et al. | |
| 5,806,955 | A | 9/1998 | Parkyn, Jr. et al. | |
| 5,986,819 | A | 11/1999 | Steinblatt | |
| 6,068,388 | A * | 5/2000 | Walker | F21V 7/0025 362/263 |
| 6,273,590 | B1 * | 8/2001 | Splane, Jr. | F21S 8/04 362/281 |
| 6,334,702 | B1 * | 1/2002 | Albou | B60Q 1/14 362/465 |
| 6,357,893 | B1 | 3/2002 | Belliveau | |
| 6,488,398 | B1 | 12/2002 | Bloch et al. | |
| 6,566,824 | B2 | 5/2003 | Panagotacos et al. | |
| 6,626,565 | B2 * | 9/2003 | Ishida | F21S 48/1757 362/304 |
| 6,796,690 | B2 | 9/2004 | Bohlander | |
| 6,985,627 | B2 | 1/2006 | Banton | |
| 7,006,306 | B2 | 2/2006 | Falicoff et al. | |
| 7,207,697 | B2 * | 4/2007 | Shoji | F21V 5/045 362/187 |
| 7,329,029 | B2 | 2/2008 | Chaves et al. | |
| 7,329,982 | B2 | 2/2008 | Conner et al. | |
| 7,605,547 | B2 | 10/2009 | Ng | |
| 7,682,038 | B2 * | 3/2010 | Wood | F21L 4/00 362/187 |
| 7,758,208 | B2 | 7/2010 | Bailey | |
| 7,808,581 | B2 | 10/2010 | Panagotacos | |
| 8,118,451 | B2 * | 2/2012 | Householder | F21V 7/0025 362/187 |
| 8,436,554 | B2 | 5/2013 | Zhao et al. | |
| 9,234,645 | B2 * | 1/2016 | Min | F21V 7/0025 |
| 2004/0264185 | A1 | 12/2004 | Grotsch et al. | |
| 2008/0062682 | A1 | 3/2008 | Hoelen et al. | |
| 2008/0238338 | A1 | 10/2008 | Latham et al. | |
| 2009/0046303 | A1 | 2/2009 | Dimitrov-Kuhl et al. | |
| 2009/0046454 | A1 | 2/2009 | Bertram et al. | |
| 2009/0219716 | A1 | 9/2009 | Weaver et al. | |
| 2010/0065860 | A1 | 3/2010 | Vissenberg et al. | |
| 2010/0097809 | A1 | 4/2010 | Munro et al. | |
| 2010/0296283 | A1 | 11/2010 | Taskar et al. | |
| 2011/0108860 | A1 | 5/2011 | Eissler et al. | |
| 2011/0149581 | A1 | 6/2011 | Jiang | |
| 2011/0182065 | A1 | 7/2011 | Negley et al. | |
| 2011/0260647 | A1 | 10/2011 | Catalano et al. | |
| 2012/0014107 | A1 | 1/2012 | Avila | |
| 2012/0018745 | A1 | 1/2012 | Liu et al. | |
| 2012/0043563 | A1 | 2/2012 | Ibbetson | |
| 2012/0319616 | A1 | 12/2012 | Quilci et al. | |
| 2013/0058103 | A1 | 3/2013 | Jiang et al. | |
| 2013/0058104 | A1 | 3/2013 | Catalano | |
| 2013/0076804 | A1 | 3/2013 | Tanaka et al. | |
| 2013/0170220 | A1 | 7/2013 | Bueeler et al. | |
| 2014/0084809 | A1 | 3/2014 | Catalano | |
| 2015/0009677 | A1 | 1/2015 | Catalano | |

FOREIGN PATENT DOCUMENTS

| | | | |
|---|---|---|---|
| DE | 102012201494 | A1 | 8/2012 |
| EP | 2093482 | A2 | 8/2009 |
| JP | 03270561 | A | 12/1991 |
| WO | 2005060376 | A2 | 7/2005 |
| WO | 2007067513 | A2 | 6/2007 |
| WO | 2008152561 | A1 | 12/2008 |
| WO | 2010015820 | A1 | 2/2010 |
| WO | 2010127217 | A1 | 11/2010 |
| WO | 2011062629 | A1 | 5/2011 |
| WO | 2014047621 | A1 | 3/2014 |
| WO | 2015006478 | A1 | 1/2015 |

OTHER PUBLICATIONS

European Patent Office, "European Office Action re Application No. 14752451.6", dated Feb. 16, 2016, pp. 2, Published in: EP.

Clay Paky, "A.LEDA Top Performance Moving Head LED-Wash", Known to exist as early as Nov. 29, 2013, pp. 7, Publisher: Website located at http://www.claypaky.it/media/documents/Clay_Paky_Aleda_Wash_Brochure_EN.pdf.

Doucet, Michel et al., "New Concept for a Wide-Angle Collimated Display", Abstract Only, Sep. 27, 2008, pp. 1, Publisher: Proceedings of SPIE.

Ebay, "FRC-M1-MCE-0R LED Lens Reflector for CREE MC-E 35mm Textured Facets", "Website located at http://www.ebay.co.uk/itm/FRC-M1-MCE-0R-LED-Lens-Reflector-for-CREE-MC-E-35mm-textured-facets-QTY-1pcs/131646672749", Known to exist as early as Nov. 2015, pp. 7, Publisher: Ebay, Published in: US.

Ebay, "FRC-M2-MCE-0R LED Lens Reflector for CREE MC-E 35mm Polished Facets", "Website located at http://www.ebay.co.uk/itm/FRC-M2-MCE-0R-LED-Lens-Reflector-for-CREE-MC-E-35mm-polished-facets-QTY-1pcs-/131646673563", Known to exist as early as Nov. 2015, pp. 7, Publisher: EBAY, Published in: US.

Henry, William, "MicroLED Arrays Find Applications in the Very Small", Mar. 2013, pp. 6, Publisher: Photonics Spectra.

Hernandez, I., "Highly Efficient Individually Addressable Diode Lasers at 830nm Grown by Solid Source Molecular Beam Epitaxy", Dec. 2001, pp. 79, vol. 13, Publisher: Sociedad Mexicana de Ciencia de Superficies y de Vacio.

Lamps 2 U Direct, "Impact 5 Watt Blue Coloured GU10 LED Light Bulb", "Website located at http://www.lamps2udirect.com/led-light-bulbs/impact-5-watt-blue-coloured-gu10-led-light-bulb/142199", Known to exist as early as Nov. 2015, pp. 6, Publisher: Lamps 2 U Direct.

Menn, Patrick, "International Search Report and Written Opinon re Application No. PCT/US2013/061378", dated Nov. 29, 2013, pp. 8.

Jeon, C.W. et al., "Fabrication of Two-Dimensional InGaN-Based Micro-LED Arrays", Jul. 12, 2002, pp. 325-328, vol. 192, No. 2, Publisher: Physica Status Solidi.

The Home Depot, "20W Equivalent Soft White (2700K) PAR38 Dimmable LED Flood Light Bulb", "Website located at http://www.homedepot.com/p/Lithonia-Lighting-20W-Equivalent-Soft-White-2700K-PAR38- Dimmable-LED-Flood-Light-Bulb-ALSP38-1200L-45-DIM", Known to exist as early as Nov. 2015, pp. 8, Publisher: Lithonia Lighting.

Neukem, Jorg, "High-Power Diode Laser Bars in the Printing Industry", Jul. 2011, pp. 22-23, No. 4, Publisher: Laser Technik Journal.

Omei Lighting, "MR16 5 W COB 450-480LM 2700-3500K Warm White Light LED Spot Bulb 12V", "Website located at http://www.omailighting.com/product/mr16-5w-cob-450-480lm-2700-3500k-warm-white-light-led-spot-bulb-12v.html", Known to exist as early as Nov. 2015, pp. 3, Publisher: Omei Lighting.

Parkyn, William A. et al., "Converging TIR Lens for Nonimaging Concentration of Light from Compact Incoherent Sources", Abstract Only, Nov. 1, 1993, pp. 2, Publisher: Proceeding SPIE.

Poher, V. et al., "Micro-LED Arrays: A Tool for Two-Dimensional Neuron Stimulation", Apr. 4, 2008, pp. 3, Publisher: Journal of Physics.

Rosenkrantz, L. Jay et al., "Light-Emitting Diode (LED) Arrays for Optical Recorders", Abstract Only, Feb. 12, 1980, pp. 1, Publisher: Proceedings of SPIE.

Skabara, Peter J. et al., "Low-Threshold Organic Semiconductor Lasers: Moving Out of the Laboratory", Nov. 29, 2010, pp. 3.

(56) References Cited

OTHER PUBLICATIONS

Super Bright LEDs, "5 Watt MR16 LED Bulb-Multifaceted Lens With High Power Epistar Cob LED", "Website located at https://www.superbrightleds.com/moreinfo/led-household-bulbs/5-watt-mr16-led-bulb--multifaceted-lens-with-high-power-epistar-cob-le", Known to exist as early as Nov. 2015, pp. 4, Publisher: Super Bright LEDs.
Vu, Jimmy T., "Office Action re U.S. Appl. No. 14/327,041", dated Nov. 22, 2015, pp. 27, Published in: US.
Gruber, Stephen S., "Response to Office Action re U.S. Appl. No. 14/327,041", dated Jan. 11, 2016, pp. 13, Published in: US.
Prouteau, Evelyne, "Invitation to Pay Additional Fees re Application No. PCT/US2014/045997", Oct. 24, 2014, pp. 5.
Becamel, Philippe, "International Preliminary Report on Patentability re Application No. PCT/US2013/061378", Mar. 24, 2014, pp. 6.
Dehestru, Bastien, "International Search Report and Written Opinion re Application No. PCT/US2014/045997", dated Jan. 5, 2015, pp. 17.
Menn, Patrick, "Written Opinion of the International Searching Authority re Application No. PCT/US2013/061378", dated Mar. 24, 2014, pp. 5.
Pham, Thai N., "Office Action re U.S. Appl. No. 14/035,027", dated Feb. 5, 2016, pp. 49, Published in: US.
Pham, Thai N., "Office Action re U.S. Appl. No. 14/035,027", dated Aug. 28, 2015, pp. 50, Published in: US.
Gruber, Stephen S., "Response to Office Action re U.S. Appl. No. 14/035,027", dated Nov. 24, 2015, pp. 11, Published in: US.

* cited by examiner

ILLUMINATION DEVICE WITH ADJUSTABLE CURVED REFLECTOR PORTIONS

CLAIM OF PRIORITY UNDER 35 U.S.C. § 119

The present Application for Patent claims priority to Provisional Application No. 62/074,287 entitled "VARIABLE-BEAM LIGHTING SYSTEM" filed Nov. 3, 2014, and assigned to the assignee hereof and hereby expressly incorporated by reference herein.

BACKGROUND

For many lighting applications, it is desirable to have an illumination source that produces a light beam having a variable angular distribution. Variability is desired, for example, to create a wide-angle light beam for illuminating an array of objects, or a narrow-angle beam for illuminating a single, small object. Conventionally, the angular distribution is varied by moving the light source(s) toward or away from the focal point of a lens or parabolic mirror. As the light source is moved away from the focal point, its image is blurred, forming a wider beam. Unfortunately, in doing so, the image is degraded, becoming non-uniform; in the case of the familiar parabolic reflector used in flashlights, a dark "donut hole" is formed, which is visually undesirable and sacrifices full illumination of the scene. Furthermore, moving the lens often reduces the collection efficiency of the lens, as light that is not refracted by a lens or reflected by a reflector surface is lost.

Because of these optical artifacts and efficiency losses, most light sources use a single, fixed lens. For light bulbs such as, e.g., MR-16 halogen bulbs, several different types of optics are manufactured to create beams of various beam divergences, ranging from narrow beam angles ("spot lights") to wide angles ("flood lights"), with various degrees in between. Unless the user maintains different light bulbs on hand to accommodate all potentially desired beam divergences, however, he or she will generally be limited to one or a small number of alternatives. Traveling with an assortment of bulbs for portable light sources is even less realistic. As a result, users often tolerate either a source ill-suited to changing or unexpected conditions, or the poor optical quality of light sources with variable beam optics. A need, therefore, exists for light sources that produce variable beam angles without sacrificing beam quality and/or provide other novel and innovative features.

SUMMARY

In some examples, a variable-beam illumination device is provided. The device has at least one light source that produces an output of light, a first discrete reflector segment, and a second discrete reflector segment. The first discrete reflector segment at least partially surrounds the at least one light source, and has a first parabolic cross section, and is shaped to produce a first light distribution having a wide-angle light distribution from at least a portion of the output. The second discrete reflector segment at least partially surrounds the at least one light source, and has a second parabolic cross section, and is shaped to produce a second light distribution from at least a portion of the output, the second light distribution from the second discrete reflector segment being narrower than the light distribution from the first discrete reflector segment. At least one of the first and second segments is movable relative to the other one of the first and second segments between a first position and a second position. A portion of the output is intercepted and reflected to effectuate the first light distribution when the at least one of the first and second segments is in the first position. A portion of the output is intercepted and reflected to effectuate the second light distribution when the at least one of the first and second segments is in the second position.

In some examples, a reflector assembly having a light source, a first discrete concave reflector segment, and a second discrete concave reflector segment is provided. The first discrete concave reflector segment at least partially surrounds the at least one light source and is shaped to produce a first light distribution, the first light distribution having a wide-angle light distribution from the output. The second discrete concave reflector segment at least partially surrounds the at least one light source and is shaped to produce a second light distribution, wherein the second light distribution from the output is narrower than the first light distribution. At least one of the first and second concave reflector segments is movable relative to the other one of the first and second concave reflector segments between a first position and a second position. A portion of the output is intercepted and reflected to effectuate the first light distribution when the at least one of the first and second concave reflector segments is in the first position. A portion of the output is intercepted and reflected to effectuate the second light distribution when the at least one of the first and second reflector segments is in the second position.

In some examples, a method of variably illuminating an object is provided. The method includes outputting light from at least one light source. The method further includes producing a first light distribution having a wide-angle light distribution from the light output using a first discrete concave reflector segment, wherein the wide-angle light distribution is not collimated. The method further includes producing a second light distribution from the light output using a second discrete concave reflector segment, the second light distribution being narrower than the first light distribution. The method further includes moving at least one of the first discrete concave reflector segment and the second discrete concave reflector segment between a first position and a second position. A portion of the output is intercepted and reflected to effectuate the first distribution when the at least one of the first and second reflector segments is in the first position. A portion of the output is intercepted and reflected to effectuate the second light distribution when the at least one of the first and second reflector segments is in the second position.

DETAILED DESCRIPTION

Figure 1A:
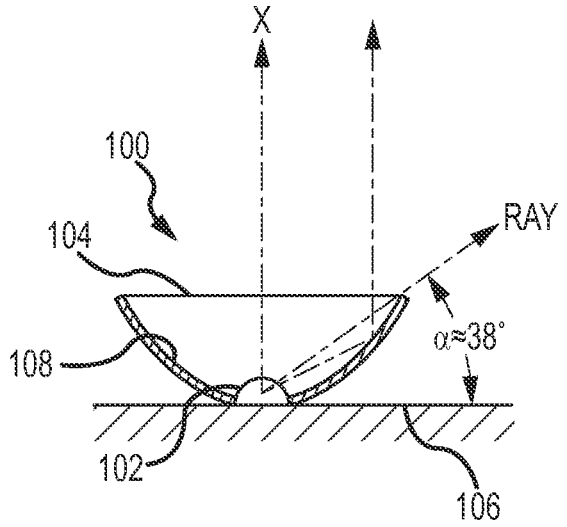
FIG. 1A is a side section view of a reflector assembly.
Figure 1B:
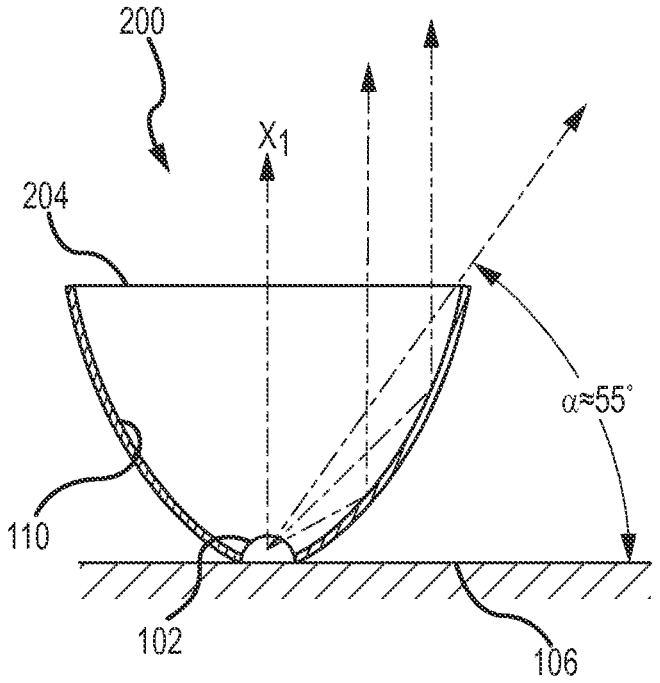
FIG. 1B is a side section view of another reflector assembly.

FIGS. 1A and 1B illustrate two circularly symmetric, collimating parabolic reflectors 100, 200 or reflector assemblies affixed respectively to a substrate 106, and each having a light source 102 having an optical axis X. The shallower reflector 100 of FIG. 1A intercepts a smaller angle and, therefore, less light than the deeper parabolic reflector 200 illustrated in FIG. 1B. In the first reflector 100, light emitted from the light source 102 at an angle $\alpha$ of about 38 degrees or less is intercepted by the reflective surface 108 and collimated as illustrated in FIG. 1A. Similarly, in the second reflector 200 illustrated in FIG. 1B, light emitted from the light source 102 at an angle a of about 55 degrees or less is intercepted and collimated by the reflective surface 110.

Those skilled in the art will understand that reflective surfaces 108, 110 defined by a parabolic function have the property that light travelling parallel to the axis of symmetry of a parabola and strikes its concave side (e.g. reflective surfaces 108, 110) is reflected to its focus, regardless of where on the parabola the reflection occurs. Conversely, light that originates from a point source at the focus is reflected into a parallel collimated beam, leaving the parabola parallel to the axis of symmetry. As illustrated, the axis of symmetry may be substantially coincident with the optical axis X of the light source.

For the purpose of this document, the terms "parabola" and "parabolic" are intended to refer to a two-dimensional curve or function. The terms may be used to refer to both sides of a mirror-symmetrical curve, as illustrated in the figures, or the terms may be used to refer to only one side of the optical axis. Relatedly, the term "paraboloid" is intended to refer to a three-dimensional surface or function. Specifically, the term "elliptic paraboloid" is intended to refer to a surface or function obtained by revolving a parabola or parabolic function around its axis. In short, the reflectors illustrated in the figures may comprise reflective surfaces that have a parabolic surface in a cross section view, and may or may not have elliptic paraboloid surfaces.

In both reflectors 100, 200, light not reflected and collimated simply propagates and widens the beam angle, so the reflector 100 of FIG. 1A produces a wider beam angle than the reflector 200 of FIG. 1B. Those skilled in the art will understand that the beam angle is defined as the angle between the two planes of light where the intensity is at least 50 percent of the maximum intensity Imax at the center beam. The average beam angle on some currently-available lights is about 25 degrees, but can be anywhere from less than 7 degrees to more than 160 degrees depending on the type of light source and reflector.

Turning now to FIGS. 2A through 2E, some embodiments provide a reflector assembly 600 having two or more parabolic or concave reflector segments 602, 604, at least one segment 604 movable relative to the other segment 602. A first reflector segment 602 closer to (e.g., mounted on) the floor or mounting surface of an illumination device such as a substrate 106 containing the light source(s) 102 is shaped to produce a wide-angle beam (see e.g. the description associated with FIGS. 1A and 1C for an understanding of the first reflector segment 602), while a second reflector segment 604 that may be moved relative to the first reflector segment 602 substantially parallel to the optical axis X is shaped to collimate light emitted by the light source 102 and produce a parallel beam of rays along a narrow angle (see e.g. Ray 1 in FIG. 2B, and FIG. 1B for an understanding of the second segment 604). A key element of some embodiments is the differing beam angles produced by each segment 602, 604, with the second segment 604 creating a narrow, collimated beam and the first segment 602 creating a wide beam. Those skilled in the art will note that, although Ray N is illustrated as collimated light in FIG. 2B, this is not necessarily the case. That is, light reflected from the first reflector segment 602 to the second reflector segment 604 may result in a scattered distribution, while light reflecting solely from the second reflector segment 604 may be collimated. This combination may provide a softening and/or reduce artifacts that might otherwise result from the space between the light source and the second segment 604.

Figure 2A:
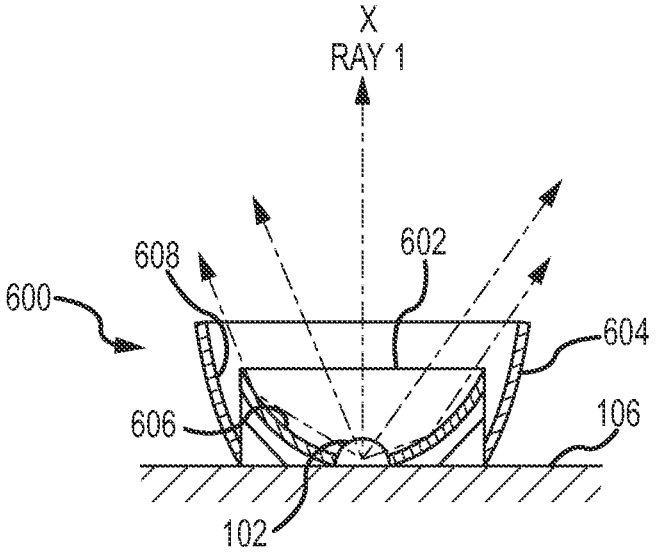
FIG. 2A is a side section view of a reflector assembly in a wide-angle mode.
Figure 2B:
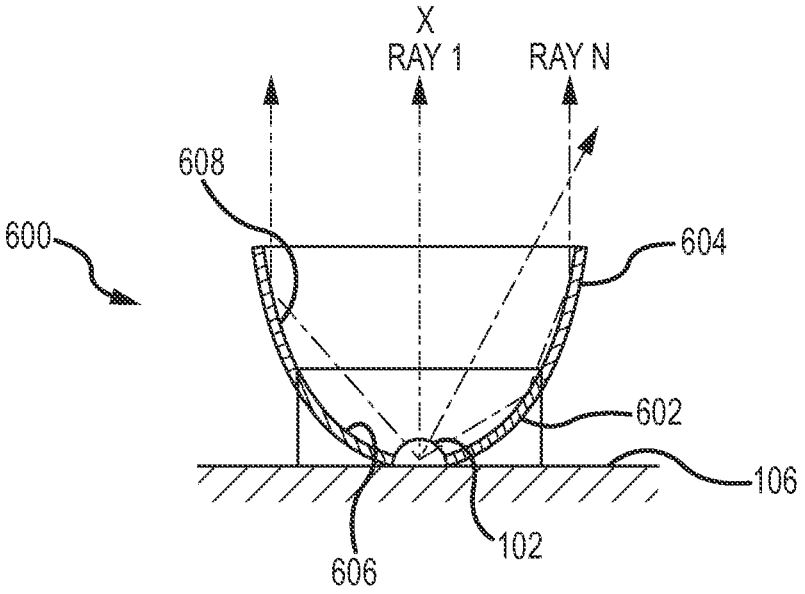
FIG. 2B is a side section view of a reflector assembly in a narrow-angle mode.
Figure 2C:
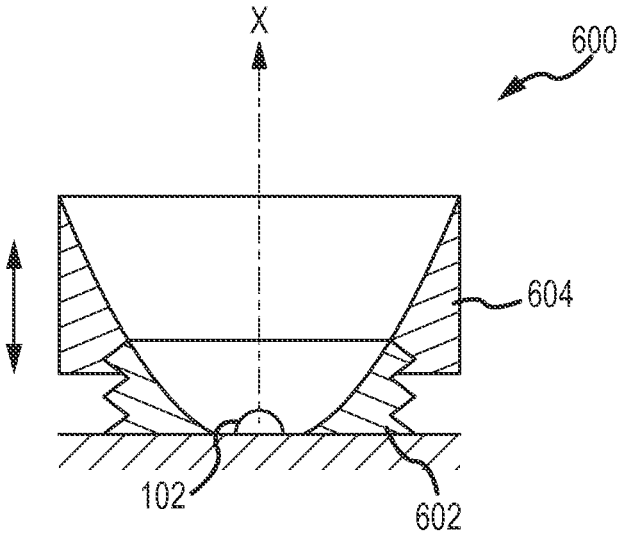
FIG. 2C is a side section view of another reflector assembly.
Figure 2D:
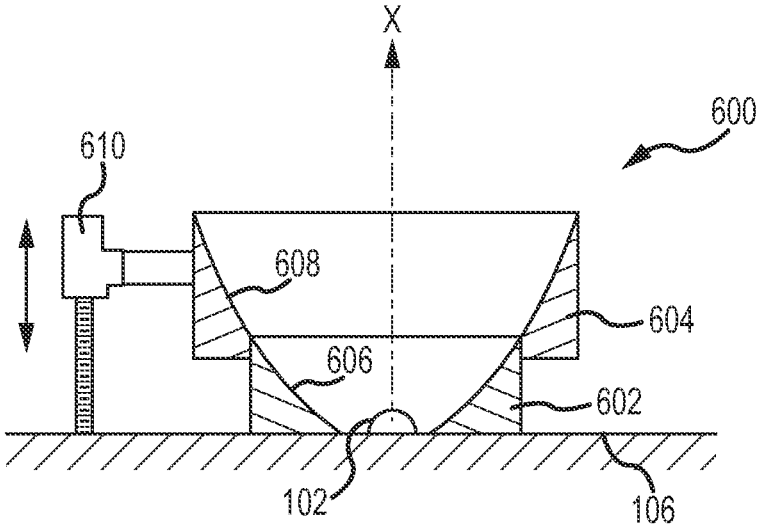
FIG. 2D is a side section view of still another reflector assembly.
Figure 2E:
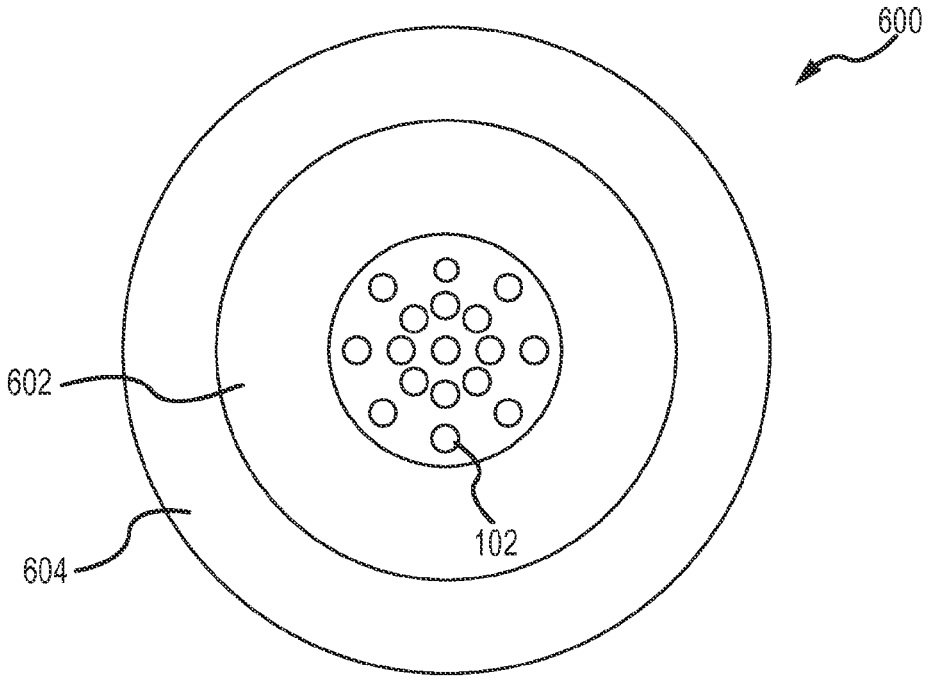
FIG. 2E is a side section view of still another reflector assembly.
Figure 2E:
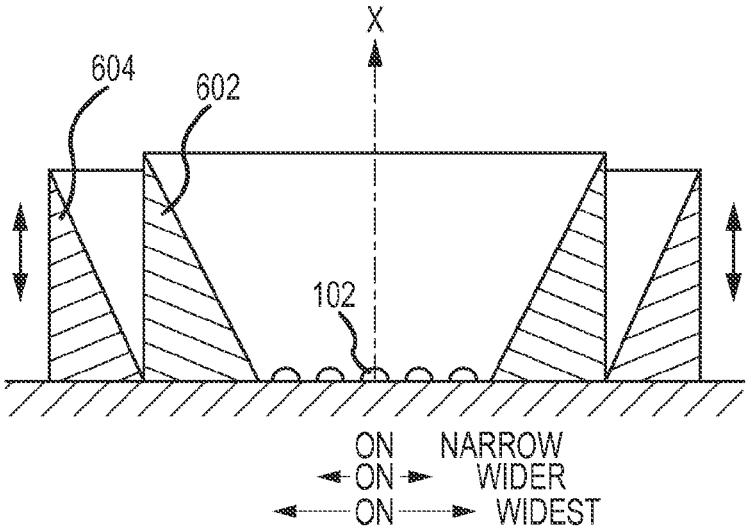

Thus, as shown in FIGS. 2A and 2E, with the second reflector segment 604 retracted, light from the light source 102 encounters only the first reflector segment 602, which creates a wide-angle beam and does not collimate the light, or does not collimate a significant portion of the light. With the second segment 604 in the raised position, as illustrated in FIG. 2B, the light is collimated into a narrow beam. Of note, the light source 102 may be an LED light source affixed or configured to be affixed to the substrate 106 and/or one or more of the reflector segments 602, 604. Likewise, one or more of the reflector segments 602, 604 may be affixed or configured for attachment to a substrate 106, the light source 102, and/or the other of the reflector segments 602, 604.

Some embodiments provide a reflector assembly 600 having a first reflector segment 602 and a second reflector segment 604, wherein the first reflector segment 602 intercepts and reflects at least some light emitted from the light source 102. The second segment 604 is movable or translatable between a first position and a second position, wherein the second segment 604 intercepts and collimates at least some light from the light source 102 and/or reflected from the first segment 602 when the second segment 604 is in the second position. The reflector assembly 600 may provide a beam angle that is narrower when the second segment 604 is in the second position than the assembly 600 provides with the second segment 604 is in the first position.

It should be noted that the second reflector segment 604 need not be fully raised or extended in order to achieve light collimation; instead, the second reflector segment 604 may be sized to collimate light when not fully raised or extended, in which case the beam angle will be larger than with the second reflector segment 604 in the fully raised or extended position. That is, the second segment 604 may be movable or translatable between a first position, a second position, and a third position. However, beam artifacts may arise if the first and second reflector segments 602, 604 are not aligned so as to produce a substantially continuous overall reflection surface.

The approach of the embodiment illustrated in FIGS. 2A-2B is to be contrasted with prior-art designs in which different reflector segments have the same parabolic shape and therefore both collimate light. That approach has a minuscule effect on beam angle, since the effect is merely to vary the size of the overall reflector rather than its optical properties.

That is, some embodiments described herein provide a first reflector segment 602 having a first reflective surface 606 defined by a first parabolic function, and a second reflector segment 604 having a second reflective surface 608 defined by a second parabolic function, the second parabolic function different from the first parabolic function. In some examples, each of the parabolic sections may have a different angle of distribution by having one or more than one focal point, thus creating a range of distribution for the light.

Those skilled in the art will understand that one or more of the reflective surfaces 606, 608 may be treated or otherwise have respective surface finishes to soften the light distribution. For example, a reflective surface 606, 608 otherwise configured to collimate light reflected therefrom may be textured or have a textured finish such that the reflective surface 606, 608 produces a wide-angle light distribution and/or produces a narrow-angle or collimated light distribution that is softened.

Some embodiments described herein provide a first reflector segment 602 having a first concave reflective surface and a second reflector segment 604 having a second concave reflective surface, wherein the first reflector segment 602 intercepts and reflects at least some light emitted from the light source 102. The second segment 604 is movable or translatable between a first position and a second position, wherein the second segment 604 intercepts and collimates at least some light from the light source 102 and/or reflected from the first segment 602 when the second segment 604 is in the second position. The reflector assembly 600 may provide a beam angle that is narrower when the second segment 604 is in the second position than the assembly 600 provides with the second segment 604 is in the first position.

Figure 1C:
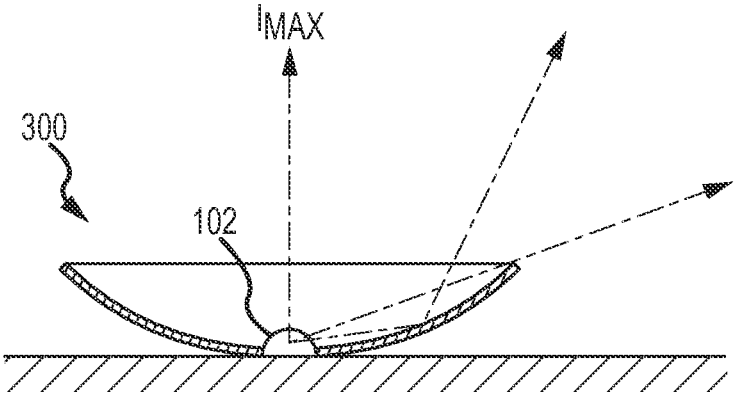
FIG. 1C is a side section view of another reflector assembly.
Figure 1D:
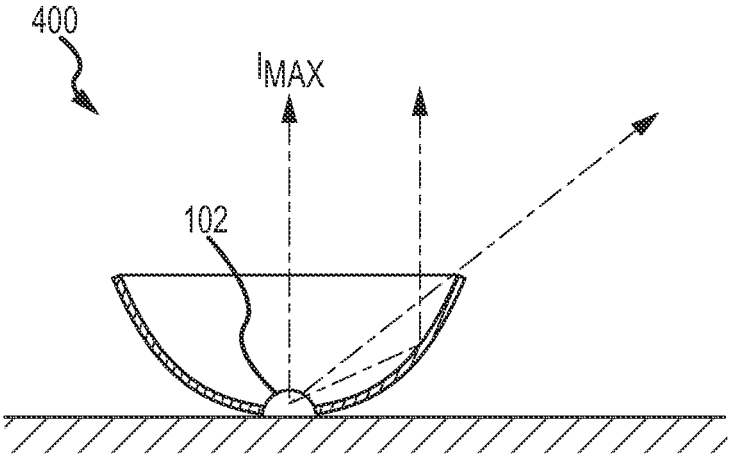
FIG. 1D is a side section view of still another reflector assembly.

The effect on the beam angle is enhanced if the lower part of the reflector also reflects light away from the optical axis instead of parallel to it, as illustrated in FIGS. 1C and 1D, noting that the reflector 400 in 1D, in which some light is reflected twice, may not be much more effective than the reflector 300 in 1C, given the lower intensity. The effect on the beam angle is enhanced still further if an array of light sources (e.g., light-emitting diodes or "LEDs") is employed and progressively turned on, depending on the amount of light desired, from the inside center of the array to the outside, as illustrated in FIG. 2E Further, although circular reflectors 100, 200, 300, 400, 500, 600 are illustrated in the attached figures, the concepts described herein are applicable to other configurations, e.g., linear reflectors with parabolic or concave cross-sections (although the beneficial effect is diminished when light can escape via the long axis of the reflector). One or both reflectors 602, 604 may have specular reflective properties or may instead have a textured metallic finish. The latter, when used in the first reflector 602, may prevent and/or reduce non-uniform light distribution that produces artifacts or other deviations from a Lambertian distribution—particularly when there is a large angular light-distribution difference between the two reflectors 602, 604.

Moreover, although two reflector segments 602, 604 are illustrated, some embodiments may provide more than two reflector segments 602, 604, such as a third reflector segment (not illustrated) substantially surrounding the light source 102 and movable relative to the first and second segments 602, 604 as will be described in subsequent portions of this disclosure. More than two reflector segments can provide greater variability.

Relative movement between the reflector segments 602, 604 may be facilitated in any suitable mechanical fashion. For example, the first reflector segment 602 may be stationary relative to the light source 102, and the second reflector segment 604 may translate on one or more friction guides that allow its position relative to the first reflector segment 602 to be set manually, by raising, lowering, extending, or otherwise translating the second reflector segment 604 relative to the optical axis X or along the guide(s). The friction guide(s) (not illustrated) retain the second reflector segment 604 in the position where it was set and preserve the alignment between the segments 602, 604.

Alternatively, the guide(s) may be smooth and the second reflector segment 604 retained in place by a lever (not illustrated) or any other suitable arrangement. In still other alternative configurations, the second reflector segment 604 may be raised, lowered, extended, or translated relative to the first reflector segment 602 by one or more gears (not illustrated), with each gear movable along a toothed rack, using a motor or manual crank.

Of course, the first reflector segment 602 may be movable instead of the second reflector segment 604, or both may be movable. In some embodiments, a mechanical stop (not illustrated) is provided so that movement is prevented beyond a certain point, e.g., where the two reflector segments 602, 604 mate to produce a substantially continuous reflector surface. The surfaces that abut when the reflector segments 602, 604 mate may be made non-reflective to avoid imaging artifacts, in case contact between the abutting surfaces is imperfect.

FIGS. 2A and 2B illustrate a single LED light source 102 for illustrative purposes. It is possible, however, to utilize an array of light sources 102, as illustrated in FIG. 2E. In these embodiments, the light sources 102 toward the perimeter of the array may be turned on (in numbers that depend on the amount of emitted light desired) first when the second reflector segment 604 is lowered or retracted, thereby enhancing the spread of the output beam, and interior light sources 102 preferentially energized instead when the second reflector segment 604 is raised or extended in order to further narrow the output beam. Suitable driver circuitry for this selective actuation is straightforwardly implemented without undue experimentation.

Figure 3:
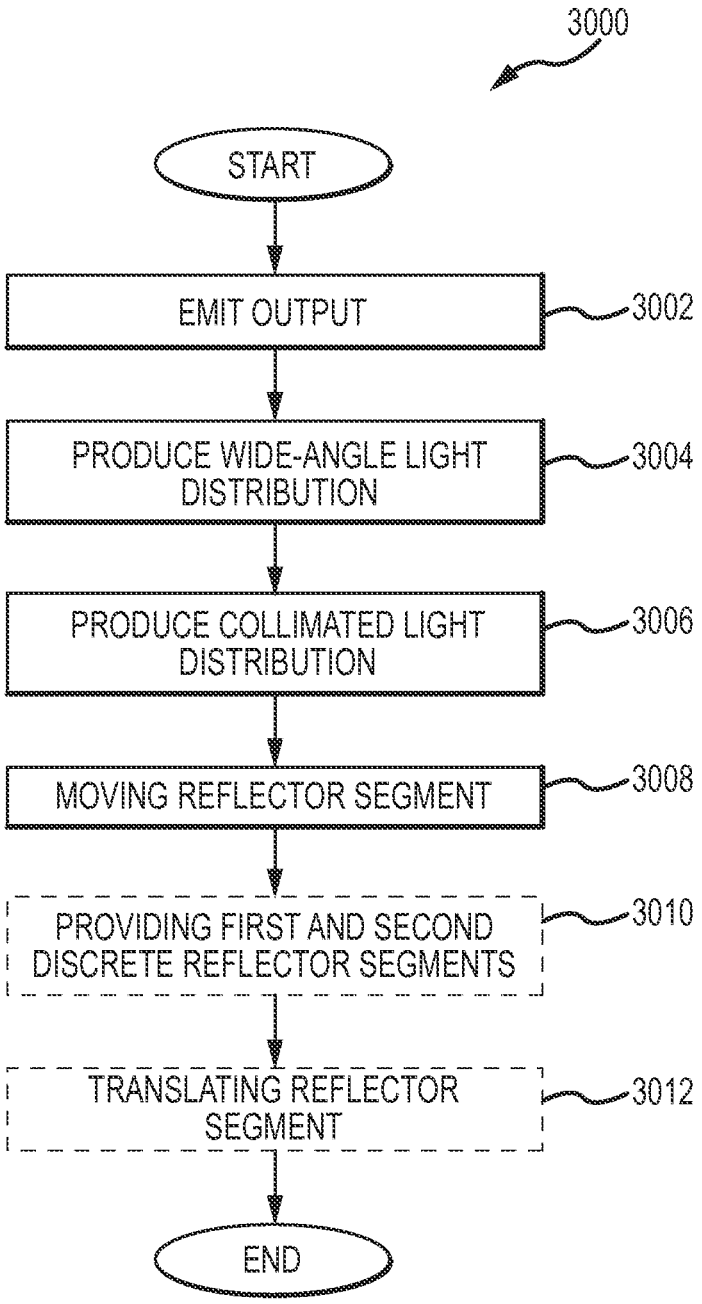
FIG. 3 is a flow chart illustrating a method.

Turning now to FIG. 3, a method 3000 of variably illuminating an object is further described. The method 3000 includes emitting 3002 an output of light from at least one light source; producing 3004 a wide-angle light distribution from the output using a first discrete concave reflector segment, wherein the wide-angle light distribution is without collimation; and producing 3006 a collimated light distribution from the output using a second discrete concave reflector segment. The method 3000 also includes moving 3008 at least one of the first discrete concave reflector segment and the second discrete concave reflector segment between a first position and a second position, wherein (a) at least a portion of the output is intercepted and reflected to effectuate the uncollimated wide-angle light distribution when the at least one of the first and second reflector segments is in the first position, and (b) at least a portion of the output is intercepted and reflected to effectuate the collimated light distribution when the at least one of the first and second reflector segments is in the second position.

The method 3000 may include providing 3010 the first discrete concave reflector segment, wherein the first discrete concave reflector segment comprises a first reflector surface defined by a first parabolic function; and providing the second discrete concave reflector segment, wherein the second discrete concave reflector segment comprises a second reflector surface defined by a second parabolic function, the second parabolic function different from the first parabolic function.

The method 3000 may include translating 3012 the at least one of the first and second discrete concave reflector segments. Translating 3012 may include translating the at least one of the first and second concave reflector segments along an axis of symmetry common to the first and second discrete concave reflector segments, and emitting an output of light having an optical axis that is substantially coincident with the axis of symmetry.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

Each of the various elements disclosed herein may be achieved in a variety of manners. This disclosure should be understood to encompass each such variation, be it a variation of an embodiment of any apparatus embodiment, a method or process embodiment, or even merely a variation of any element of these. Particularly, it should be understood that the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled.

As but one example, it should be understood that all action may be expressed as a means for taking that action or as an element which causes that action. Similarly, each physical element disclosed should be understood to encompass a disclosure of the action which that physical element facilitates. Regarding this last aspect, by way of example only, the disclosure of a reflector should be understood to encompass disclosure of the act of reflecting—whether explicitly discussed or not—and, conversely, were there only disclosure of the act of reflecting, such a disclosure should be understood to encompass disclosure of a "reflector mechanism". Such changes and alternative terms are to be understood to be explicitly included in the description.

The previous description of the disclosed embodiments and examples is provided to enable any person skilled in the art to make or use the present invention as defined by the claims. Thus, the present invention is not intended to be limited to the examples disclosed herein. Various modifications to these embodiments will be readily apparent to those skilled in the art, and the generic principles defined herein may be applied to other embodiments without departing from the spirit or scope of the invention as claimed.

What is claimed is:

1. A reflector assembly for a variable-beam illumination device comprising:

an array of light sources that produces an output of light;

a first discrete concave reflector segment at least partially surrounding the array of light sources and shaped to produce a first light distribution, the first light distribution having a wide-angle light distribution from the output;

a second discrete concave reflector segment at least partially surrounding the array of light sources and shaped to produce a second light distribution, wherein the second light distribution from the output is narrower than the first light distribution; and means for selectively activating the array of light sources, wherein at least one of the first and second concave reflector segments is movable relative to the other one of the first and second concave reflector segments between a first position and a second position, such that:

(a) the outer light sources of the array of light sources are selectively activated by the means and a portion of the output is intercepted and reflected to effectuate the first light distribution when the at least one of the first and second concave reflector segments is in the first position, and (b) the inner light sources of the array of light sources are selectively activated by the means and a portion of the output is intercepted and reflected to effectuate the second light distribution when the at least one of the first and second reflector segments is in the second position.

2. The reflector assembly of claim 1, wherein the first and second reflector segments comprise a common axis of symmetry;

the at least one of the first and second reflector segments is configured to translate along the common axis of symmetry; and the reflector assembly is configured and shaped to couple to a light source whereby an optical axis of the light source is substantially coincident with the common axis of symmetry.

3. The reflector assembly of claim 1, wherein the first light distribution is uncollimated; and a majority of the second light distribution is collimated.

4. The reflector assembly of claim 1, wherein the first discrete concave reflector segment comprises a first reflector surface having a cross-section profile defined by a first parabolic function; and the second discrete concave reflector segment comprises a second reflector surface having a cross-section profile defined by a second parabolic function, the second parabolic function different from the first parabolic function.

5. The reflector assembly of claim 4, wherein the first and second reflector segments comprise a common axis of symmetry;

the at least one of the first and second reflector segments is configured to translate along the common axis of symmetry; and the reflector assembly is configured and shaped to couple to the array of light sources wherein an optical axis of the array of light sources is substantially coincident with the common axis of symmetry.

6. The reflector assembly of claim 4, wherein the array of light sources comprises an elongated array of light sources, and each of the first and second concave reflector segments are elongated; or each of the first and second reflector surfaces comprises an elliptic paraboloid reflective surface.

7. A variable-beam illumination device comprising:

an array of light sources that produces an output of light;

a first discrete reflector segment at least partially surrounding the array of light sources, the first discrete reflector segment having a first parabolic cross section and shaped to produce a first light distribution having a wide-angle light distribution from at least a portion of the output;

a second discrete reflector segment at least partially surrounding the array of light sources, the second discrete reflector segment having a second parabolic cross section and shaped to produce a second light distribution from at least a portion of the output, the second light distribution from the second discrete reflector segment being narrower than the light distribution from the first discrete reflector segment; and means for selectively activating the array of light sources, wherein at least one of the first and second segments is movable relative to the other one of the first and second segments between a first position and a second position, such that:

(a) the outer light sources of the array of light sources are selectively activated by the means and a portion of the output is intercepted and reflected to effectuate the first light distribution when the at least one of the first and second segments is in the first position, and (b) the inner light sources of the array of light sources are selectively activated by the means and a portion of the output is intercepted and reflected to effectuate the second light distribution when the at least one of the first and second segments is in the second position.

8. The device of claim 7, wherein the output does not encounter the second reflector segment when the at least one of the first and second reflector segments is in the first position.

9. The device of claim 7, wherein the second reflector segment is movable relative to the first reflector segment.

10. The device of claim 7, wherein the at least one of the first and second reflector segments is translatable relative to an optical axis of the array of light sources.

11. The device of claim 7, wherein the first reflector segment comprises a first concave reflector surface defined by a first paraboloid function; and the second reflector segment comprises a second concave reflector surface defined by a second paraboloid function, the second paraboloid function different from the first paraboloid function.

12. The device of claim 7, wherein the second segment is configured to collimate a majority of the light that is intercepted by the second segment.

13. The device of claim 7, wherein at least a portion of the output encounters both the first and second reflector segments when the at least one of the first and second reflector segments is in the second position.

14. The device of claim 13, wherein the first and second reflector segments mate to form a substantially continuous reflective surface when the at least one of the first and second reflector segments is in the second position.

15. A method of variably illuminating an object, the method comprising:

outputting light from an array of light sources;

producing a first light distribution having a wide-angle light distribution from the light output using a first discrete concave reflector segment, wherein the wide-angle light distribution is not collimated;

producing a second light distribution from the light output using a second discrete concave reflector segment, the second light distribution being narrower than the first light distribution;

moving at least one of the first discrete concave reflector segment and the second discrete concave reflector segment between a first position and a second position; and selectively activating the array of light sources, wherein (a) the outer light sources of the array of light sources are activated, and a portion of the output is intercepted and reflected to effectuate the first distribution, when the at least one of the first and second reflector segments is in the first position, and (b) the inner light sources of the array of light sources are activated, and a portion of the output is intercepted and reflected to effectuate the second light distribution, when the at least one of the first and second reflector segments is in the second position.

16. The method of claim 15, wherein the first and second discrete concave reflector segments comprise a common axis of symmetry; and wherein the method comprises translating the at least one of the first and second discrete concave reflector segments along the common axis of symmetry; and emitting an output of light comprises emitting an output of light having an optical axis that is substantially coincident with the common axis of symmetry.

17. The method of claim 15, further comprising:

providing the first discrete concave reflector segment, wherein the first discrete concave reflector segment comprises a first reflector surface defined by a first parabolic cross section function or paraboloid function; and providing the second discrete concave reflector segment, wherein the second discrete concave reflector segment comprises a second reflector surface defined by a second parabolic cross section function or paraboloid function, the second function different from the first function.

18. The method of claim 17, further comprising:

translating the at least one of the first and second discrete concave reflector segments along an axis of symmetry common to the first and second discrete concave reflector segments; and wherein emitting an output of light comprises emitting an output of light having an optical axis that is substantially coincident with the axis of symmetry.

* * * * *